US006209854B1

(12) United States Patent
Sedlack et al.

(10) Patent No.: US 6,209,854 B1
(45) Date of Patent: Apr. 3, 2001

(54) SUSPENDED STAIR RAILING FOR CHILDREN

(76) Inventors: Mark A. Sedlack, 1929 Olympic St., Cuyahoga Falls, OH (US) 44221; William M. Miller, 18630 Shaw Rd., Hiram, OH (US) 44234

( * ) Notice: Subject to any disclaimer, the term of this patent is extended or adjusted under 35 U.S.C. 154(b) by 0 days.

(21) Appl. No.: 09/178,307

(22) Filed: Oct. 23, 1998

(51) Int. Cl.[7] ..... E04F 11/18

(52) U.S. Cl. ..... 256/59; 256/66; 52/184; 52/726.1

(58) Field of Search ..... 256/23, 59, 65, 256/66, DIG. 6; 52/182, 184, 726.1, 726.2

(56) References Cited

U.S. PATENT DOCUMENTS 3,005,242 * 10/1961 Roberts .
3,342,457 * 9/1967 Bobrowski ..... 256/65 X
4,465,262 * 8/1984 Itri et al. ..... 256/23 X
4,556,201 * 12/1985 Turner ..... 256/59
4,948,100 * 8/1990 Stevens ..... 256/65
5,337,528 * 8/1994 Jaworski et al. ..... 52/182
5,657,968 * 8/1997 Marsden ..... 256/65
5,853,166 * 12/1998 Koza ..... 256/59

* cited by examiner

*Primary Examiner*—Robert Canfield
(74) *Attorney, Agent, or Firm*—Renner, Kenner, Greive, Bobak, Taylor & Weber

(57) ABSTRACT

A children's handrail assembly consists of four equally spaced connector brackets having three sections of plastic tubing interconnected therebetween. The connector brackets are secured to a standard handrail by means of cable ties which pass through apertures in the connector bracket and pull tightly around the standard handrail. The children's handrail can be applied to either wall mounted or spindle supported standard handrails. When wall mounted, the connector brackets urge against the wall surface. When spindle mounted, an additional cable tie may be employed to secure the bracket to a spindle.

12 Claims, 2 Drawing Sheets

SUSPENDED STAIR RAILING FOR CHILDREN

TECHNICAL FIELD

The invention herein resides in the field of home products and, more particularly, to stair railings. Specifically, the invention relates to a stair railing adapted to be suspended beneath a standard railing, with the suspended railing being so positioned and secured to accomodate use by children and toddlers.

BACKGROUND ART

As a child develops, one of the most challenging experiences encountered is that of negotiating stairs. While crawling and walking are generally learned without great difficulty and without significant harm to the child, learning to move up and down stairs is not only difficult, but somewhat dangerous. While stair railings are typically provided in association with most stairways, these railings are typically positioned sufficiently above the stairs to accomodate adults. As such, they are out of the reach of youngsters, and provide little if any assistance in their learning to negotiate the stairs. Indeed, standard handrails are so positioned that any attempts by a toddler to reach a handrail actually compromises his or her ability to climb or descend the stairs.

In the past, it has been known to actually affix a lower rail to a wall or other permanent structure in order to accomodate youngsters. However, such attachments have generally been of a semi-permanent nature and have required repair, such as patching of screw holes and the like, when removed. The prior art has also suggested other approaches to securing lower handrails in association with stairs, but such approaches have generally not been of a sufficiently secure nature to provide the child with the necessary confidence to negotiate the stairs in a safe manner and they have typically been of a complex and expensive design, not given to ease of application. Accordingly, there remains in the art a need for a temporary suspended stair rail for children which may be easily and securely attached to and suspended from a standard stair railing.

SUMMARY OF INVENTION

In light of the foregoing, it is a first aspect of the invention to provide a suspended stair railing for children which may be securedly attached to an existing standard stair railing.

Another aspect of the invention is the provision of a suspended stair railing for children which is easy to install and remove.

Yet a further aspect of the invention is the provision of a suspended stair railing for children which is adapted for application to both spindle and wall mounted railings.

Still a further aspect of the invention is the provision of a suspended stair railing for children which is lightweight, durable, not given to damaging of walls or other portions of the stairway, and which is easy to implement within the state of the art.

Another aspect of the invention is the provision of a suspended stair railing which is modular in nature, accommodating stairway portions or flights of various lengths.

The foregoing and other aspects of the invention which will become apparent as the detailed description proceeds are achieved by a children's handrail assembly for secured suspension beneath a standard handrail, comprising: a first plurality of connector brackets; a second plurality of cable ties securing said connector brackets to the standard handrail; and a third plurality of tubes interposed between and interconnected with said connector brackets.

Yet other aspects of the invention which will become apparent herein are attained by a child's handrail for interconnection with and suspension from a standard handrail, comprising: a plurality of tubes interconnected by a plurality of connector brackets, each said connector bracket being secured to the standard handrail by a cable tie, and wherein each said connector bracket comprises: a web-like body portion encompassed by a flange, said flange defining an enlarged head portion; a cradle positioned at a top edge of said enlarged head portion, said cradle adapted for engaging the standard handrail; a bumper interposed between said cradle and standard handrail; and a plurality of apertures passing through said enlarged head portion for receiving said cable ties and nesting said cradle against said standard handrail.

BRIEF DESCRIPTION OF THE DRAWINGS

For a complete understanding of the objects, techniques and structure of the invention reference should be made to the following detailed description and accompanying drawing wherein.

BEST MODE FOR CARRYING OUT THE INVENTION

Figure 1:
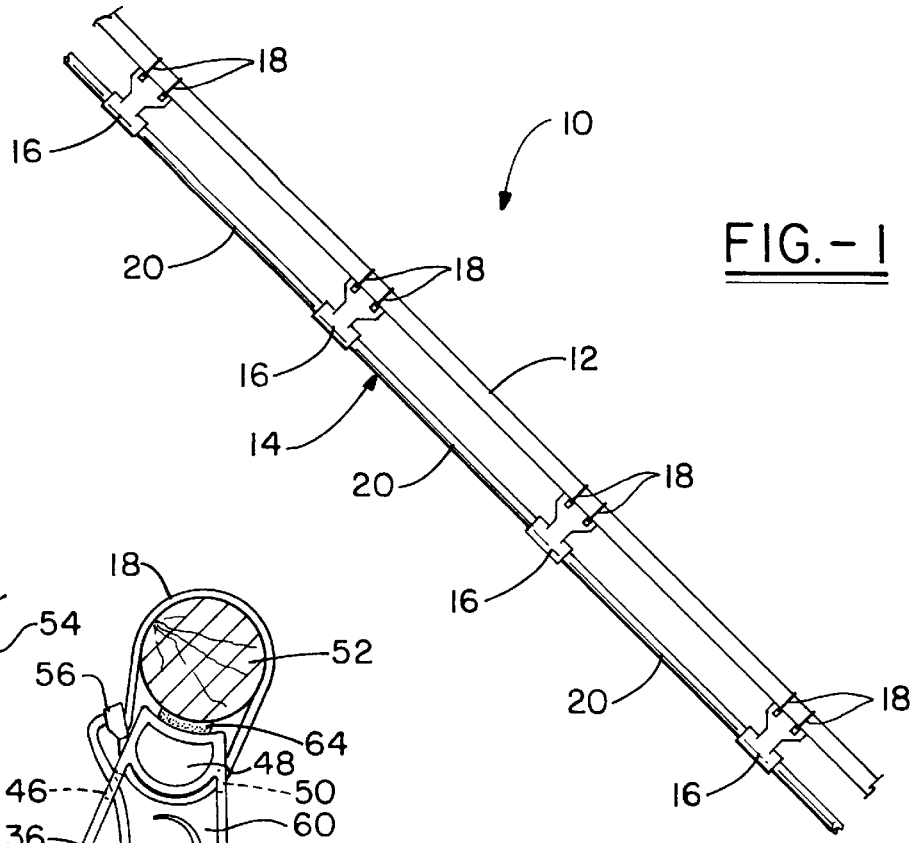
FIG. 1 is an illustrative view of the children's handrail of the invention, showing the same connected to and suspended from a standard hand railing.

Referring now to the drawings and more particularly FIG. 1, it can be seen that a bannister or handrail assembly made in accordance with the invention is designated generally by the numeral 10. Children's hand railing assembly 10 is adapted for connection to a permanent standard handrail 12, which would typically be fixed to a wall by mounting supports, or maintained atop spindles. The child's handrail 14 is attached to and suspended from the standard handrail 12. A plurality of connector brackets 16 are attached to the standard handrail 12 by means of cable ties 18. A plurality of tubes 20 are interposed between and secured to the connector brackets 16, as illustrated. While it will be appreciated that the specific structure and configuration of the child's hand railing assembly can be of various configurations, it will be noted that according to the preferred embodiment of the invention there are included four substantially identical connector brackets 16, with three plastic tubes 20 of equal length interposed therebetween. It will also be appreciated by those skilled in the art that the child's handrail 14 is positioned beneath the standard handrail 12 by a distance determined by the height of the connector brackets 16. Accordingly, it win be appreciated that the child's handrail 14 is maintained parallel to and suspended beneath the standard handrail 12.

Figure 2:
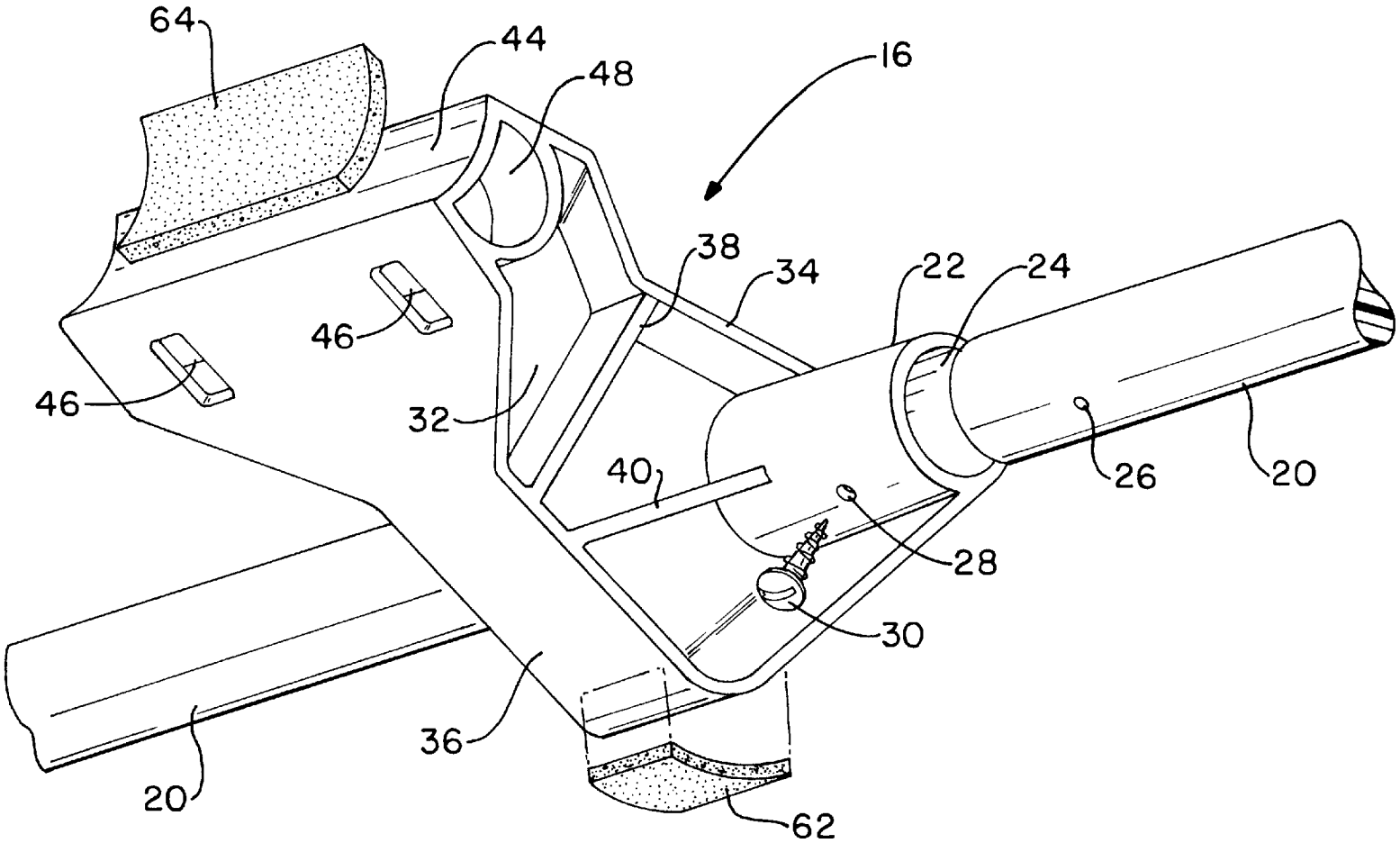
FIG. 2 is a pictorial view of a connector bracket as employed in accordance with the invention, showing the same receiving a tubing defining the railing.

With continued reference to FIG. 1 and additional reference to FIG. 2, it can be seen that each of the connector brackets 16 includes a pair of collars 22, axially aligned and extending in opposite directions from the connector bracket 16. Each collar 24 includes a receptacle or bore 24 for receiving the plastic tubing 20. Screw holes 26, 28 are provided respectively in the tube 20 and collar 22 receiving a screw 30 to securedly nest the tube 20 within the receptacle 24.

The connector brackets 16 include a web-like body portion 32 having edge flanges 34, 36 encompassing the same. Inner ribs 38, 40 extend across the web 32 and between the flanges 34, 36 or the flange 36 and collar 22 for purposes of strengthening and securing the plastic molded connector brackets 16.

The flanges 34, 36 expand into a broadened head portion 42 at a top end of connector bracket 16 opposite the lower end receiving the collars 22. At the top of the broadened head portion 42 is a cradle 44 particularly adapted for engagement with the underside of a standard hand railing. A plurality of apertures 46 pass through the broadened head portion 44 and beneath a crescent-shaped recess 48 positioned beneath the cradle 44. It will be appreciated that a plurality of recesses are defined within the connector bracket 16 by virtue of the web-like body portion 32, having flanges 34, 36 extending from the periphery thereof and the ribs 38, 40 traversing the body thereof.

Figure 3:
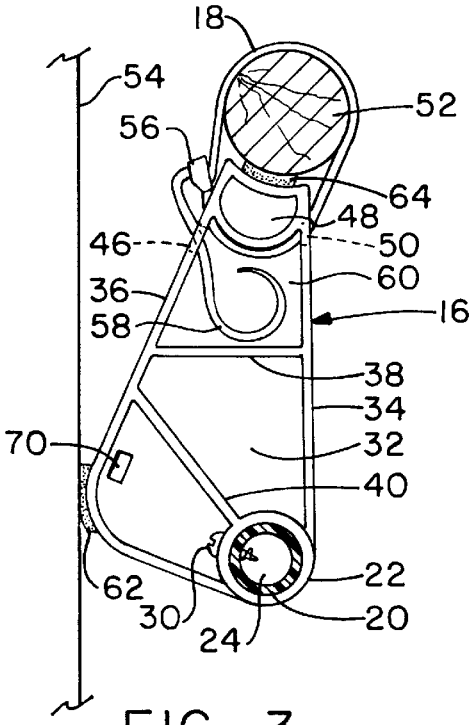
FIG. 3 is a side sectional view of a connector bracket of the invention, showing the same attached to a wall mounted standard hand railing.
Figure 4:
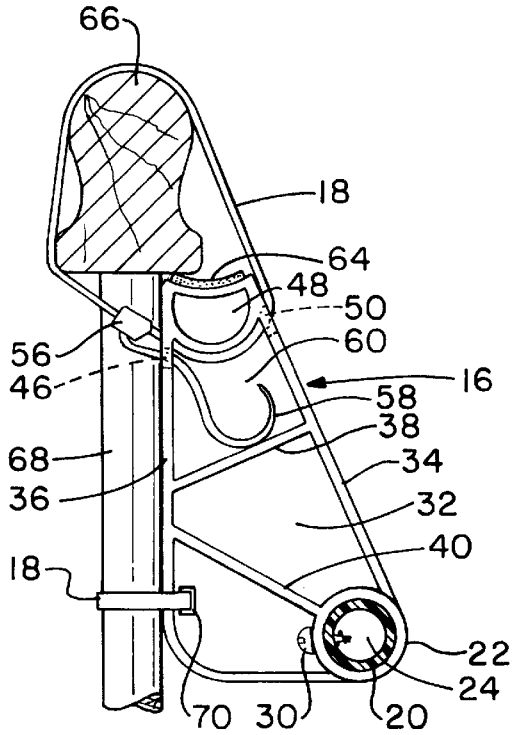
FIG. 4 is a side sectional view of the connector bracket of the invention, showing the same secured to a spindle mounted standard hand railing.

With additional reference now to FIGS. 3 and 4, further appreciation of connector brackets 16 can be obtained, with particular reference to such connector brackets being secured to a wall mounted handrail 52 (FIG. 3) and to a spindle supported standard handrail 66 (FIG. 4). As shown, the connector bracket 16 further includes a pair of apertures 50 opposite the apertures 46 for receiving the cable ties 18 which are adapted for securing the connector brackets 16 to one of the handrails 5,2 66. In FIG. 3, the handrail 52 is mounted upon a wall 54 by appropriate brackets (not shown). A cable tie 18 passes through the apertures 46, 50, around the standard handrail 52, through a cable tie lock 56, and pulled tight for nesting securing engagement of the cradle 44 against the underside of the railing 52. The tail 58 of the cable tie 18 which extends beyond the lock 56 may then be passed back through the aperture 56 to be received within the recess 60 defined between the flanges 34, 36 and ribs 38 and beneath the crescent-shaped recess 48. The back end of the bracket 16 is configured in a generally L-shaped manner to abut against the wall 54.

In accordance with the invention, a foam pad or bumper 62 is attached at the bend of the L-shaped back portion of connector 16 for contacting engagement with the wall 54. The bumper 62, being preferably of foam construction, prevents the bracket 16 from marring or otherwise damaging the wall 54. A similar foam pad or bumper 64 is interposed between the cradle 44 and the bottom side of the railing 52. The bumper 64 is compressively engaged between the cradle 44 and the railing 52 and thereby provides frictional engagement that precludes rotation or sliding movement of the connector 16 with respect to the railing 52. Those skilled in the art will appreciate that the foam pads or bumpers 62, 64 are preferably adhesively attached to the connector bracket 16 in the positions shown. While the invention also contemplates that the foam pads or bumpers 62, 64 may comprise a double backed adhesive foam member, it is contemplated that only a single surface will receive adhesive for attachment to the connectors 16.

With specific reference to FIG. 4, it can be seen that a handrail 66 is adapted to be maintained atop a plurality of spindles 68. For implementation of a children's handrail in association with such a standard handrail, the mounting follows that shown in FIG. 4. Here again, cable ties 18 pass through the sets of paired apertures 46, 50 beneath the crescent-shaped recess 48 and pass around the standard railing 66 and are securedly locked into engagement by tightening of cable tie 18 in the lock 56. The tail 58 is passed back through the aperture 46 for concealed receipt in recess 60. Of course, as with the embodiment of FIG. 3, two such cable ties are used, one in each set of the paired apertures 46, 50. Also, the foam pad or bumper 64 is maintained in the cradle 44 for engagement with the underside of the rail 66 for frictional nonslipping engagement.

Further secured engagement can be achieved with the spindle mounting technique by employing yet another cable tie 18 which passes through the aperture 70 in the web-like body portion 32 of the connector bracket 16. Accordingly, in the spindle mounted embodiment, both horizontal and vertical connections are made between the connector bracket 16 and the spindle mounted handrail.

It will be appreciated by those skilled in the art that the locking cable ties 18, plastic tubes 20, screws 30 and bumpers 62, 64 are readily available items. Only connector brackets 16 are uniquely devised for implementation with the invention. The connector brackets 16 are, as mentioned above, readily formed by a plastic molding operation.

It will also be readily appreciated by those skilled in the art that the assembly and installation of the children's handrail made in accordance with the invention can be easily attained. In general, the tubes 20 are interconnected with connector brackets 16 by means of the screws 30 with those elements being maintained upon the floor. The appropriate bumpers 62, 64 are then adhesively attached, as necessary, to cradle 44 and to the knee of L-shaped flange 36, as needed. Cable ties 18 are also passed through corresponding apertures 46, 50, two such cable ties being used for each such connector. The assembly is then lifted and placed in association with the permanent standard hand railing 52, 66 and secured engagement is made by simply passing the end of each of the cable ties 18 through its associated lock 56. In the event that a spindle mount is employed, additional ties 18 are passed through the apertures 70 for locking engagement.

It has been found that the children's hand railing made in accordance with the invention provides a safe and secure device for allowing children and toddles to have the security of a hand railing while ascending and descending a stairway. It has further been found that the system is easy to install, reliable and durable in operation, and easy to remove by simply following the reverse steps of installation.

Thus it can be seen that the objects of the invention have been satisfied by the structure presented above. While in accordance with the patent statutes only the best mode and preferred embodiment of the invention has been presented and described in detail, the invention is not limited thereto or thereby. Accordingly, for an appreciation of the true scope and breadth of the invention reference should be made to the following claims.

What is claimed is:

1. A children's handrail assembly for secured suspension beneath a standard handrail, comprising:

a first plurality of connector brackets;

a second plurality of cable ties for securing said connector brackets to the standard handrail; and a third plurality of tubes interposed between and interconnected with said connector brackets.

2. The children's handrail assembly according to claim 1, wherein each said connector bracket has a cylindrical collar for receiving an end of one of said tubes.

3. The children's handrail assembly according to claim 2, wherein said tubes are secured in said cylindrical collars by fasteners.

4. The children's handrail assembly according to claim 2, wherein each said connector bracket comprises a web-like body portion having said cylindrical body portions at a bottom end thereof, and a broadened head portion at a top portion thereof.

5. The children's handrail assembly according to claim 4, wherein said broadened head portion comprises a cradle adapted for engaging an underside of the standard handrail.

6. The children's handrail assembly according to claim 5, wherein said cradle receives a first bumper.

7. The children's handrail assembly according to claim 5, wherein a plurality of apertures pass through said broadened bead portion, said apertures receiving said cable ties.

8. The children's handrail assembly according to claim 7, wherein each said cable tie includes a lock for tightening engagement of said cradle against the standard handrail, and wherein each said connector bracket includes a recess for receiving and maintaining a tail of an associated one of said cable ties.

9. The children's handrail assembly according to claim 8, wherein said connector brackets are of molded plastic.

10. The children's handrail assembly according to claim 8, wherein each said connector bracket further comprises an exterior flange encompassing said web-like body portion.

11. The children's handrail assembly according to claim 10, wherein each said connector bracket further comprises ribs traversing said web-like body portion.

12. A child's handrail for interconnection with and suspension from a standard handrail, comprising:

a plurality of tubes interconnected by a plurality of connector brackets, each said connector bracket being adapted to be secured to a standard handrail by a cable tie, and wherein each said connector bracket comprises:

a web-like body portion encompassed by a flange, said flange defining an enlarged head portion;

a cradle positioned at a top edge of said enlarged head portion, said cradle adapted for engaging the standard handrail;

a bumper adapted to be interposed between said cradle and a standard handrail; and a plurality of apertures passing through said enlarged head portion for receiving said cable ties and nesting said cradle against said standard handrail.

* * * * *